US010731390B2

(12) United States Patent
Da Deppo et al.

(10) Patent No.: US 10,731,390 B2
(45) Date of Patent: Aug. 4, 2020

(54) RETENTION MECHANISM FOR INSERTION MEMBER IN VEHICULAR DOOR HANDLE ASSEMBLY

(71) Applicant: HUF NORTH AMERICA AUTOMOTIVE PARTS MFG. CORP., Milwaukee, WI (US)

(72) Inventors: Lynn D. Da Deppo, Bloomfield Hills, MI (US); Ehab Kamal, Novi, MI (US); Suat Kaya, Novi, MI (US); Yusuf Yanikoglu, Ann Arbor, MI (US)

(73) Assignee: HUF NORTH AMERICA AUTOMOTIVE PARTS MFG. CORP., Milwaukee, WI (US)

( * ) Notice: Subject to any disclaimer, the term of this patent is extended or adjusted under 35 U.S.C. 154(b) by 0 days.

(21) Appl. No.: 16/229,424

(22) Filed: Dec. 21, 2018

(65) Prior Publication Data

US 2019/0128029 A1 May 2, 2019

Related U.S. Application Data

(63) Continuation of application No. 14/737,934, filed on Jun. 12, 2015, now Pat. No. 10,196,842.
(Continued)

(51) Int. Cl.
*E05B 85/16* (2014.01)
*E05B 85/06* (2014.01)
(Continued)

(52) U.S. Cl.
CPC ..... *E05B 85/16* (2013.01); *E05B 9/084* (2013.01); *E05B 85/06* (2013.01); *E05B 85/10* (2013.01);
(Continued)

(58) Field of Classification Search
None
See application file for complete search history.

(56) References Cited

U.S. PATENT DOCUMENTS 6,109,669 A * 8/2000 Pinkow ..... E05C 1/145 292/175
6,364,375 B1 4/2002 Szapucki et al.
(Continued)

FOREIGN PATENT DOCUMENTS

CN 103154407 A 6/2013
DE 3030519 A1 2/1982
(Continued)

OTHER PUBLICATIONS

The State Intellectual Property Office (PRC), Office Action for CN Application No. 201510344760.9, dated Jun. 13, 2018.
(Continued)

*Primary Examiner* — Carlos Lugo
(74) *Attorney, Agent, or Firm* — Honigman LLP; Brandon C. Griffith; Jonathan P. O'Brien

(57) ABSTRACT

A door handle assembly includes a bracket mountable to the door and an insertion member received in and retained in the bracket via a retaining mechanism. The retaining mechanism includes a biasing member and a movable locking member that retains the insertion member in the bracket. The movable locking member is biased into a securing position by the biasing member when the insertion member is fully received in the bracket to retain the insertion member in the bracket. The movable locking member is selectively displaceable from the securing position against a force of the biasing member either to permit insertion of the insertion member in the bracket during assembly or to accommodate disassembly by permitting the insertion member to be removed from the bracket.

19 Claims, 5 Drawing Sheets

Related U.S. Application Data

(60) Provisional application No. 62/014,870, filed on Jun. 20, 2014.

(51) Int. Cl.
*E05B 9/08* (2006.01)
*E05B 85/10* (2014.01)

(52) U.S. Cl.
CPC ..... *Y10S 292/04* (2013.01); *Y10T 29/49828* (2015.01); *Y10T 292/57* (2015.04)

(56) References Cited

U.S. PATENT DOCUMENTS

| | | | |
|---|---|---|---|
| 6,401,302 | B1 | 6/2002 | Josserand et al. |
| RE37,916 | E | 12/2002 | Szapucki et al. |
| 6,523,871 | B1 | 2/2003 | Josserand |
| 6,834,901 | B2 | 12/2004 | Low |
| 6,901,638 | B2 | 6/2005 | Itou et al. |
| 7,140,650 | B2 | 11/2006 | Berg |
| 7,146,832 | B2 | 12/2006 | Mathofer |
| 7,260,964 | B2 | 8/2007 | Velicanin et al. |
| 7,914,054 | B2 | 3/2011 | Blake, III |
| 8,468,661 | B2 | 6/2013 | Brownlow et al. |
| 10,196,842 | B2 * | 2/2019 | Da Deppo ..... E05B 85/16 |
| 2011/0296655 | A1 | 12/2011 | Brownlow et al. |

FOREIGN PATENT DOCUMENTS

| | | | |
|---|---|---|---|
| DE | 4445320 | A1 | 8/1996 |
| DE | 102004007083 | B3 | 9/2005 |
| DE | 102009043933 | A1 | 3/2011 |
| DE | 102011121570 | A1 | 6/2013 |
| DE | 102013222465 | A1 | 5/2015 |
| EP | 1449993 | A1 | 8/2004 |
| EP | 2562338 | A2 | 2/2013 |
| EP | 2977532 | A1 | 1/2016 |
| EP | 3085864 | A1 | 10/2016 |

OTHER PUBLICATIONS

USPTO, Non-Final Office Action for U.S. Appl. No. 14/737,934, dated Jun. 7, 2018.
USPTO, Final Office Action for U.S. Appl. No. 14/737,934, dated Mar. 5, 2018.
USPTO, Non-Final Office Action for U.S. Appl. No. 14/737,934, dated Sep. 12, 2017.

* cited by examiner

10

26
B
14
30
6
16
20
12
18
28
36
32
24

RETENTION MECHANISM FOR INSERTION MEMBER IN VEHICULAR DOOR HANDLE ASSEMBLY

CROSS-REFERENCE TO RELATED APPLICATIONS

This application is a continuation of U.S. patent application Ser. No. 14/737,934, filed Jun. 12, 2015, which claims the benefit of the filing date of U.S. Provisional Patent Application No. 62/014,870 filed Jun. 20, 2014. These prior applications are hereby incorporated by reference for all purposes as if set forth in their entirety herein.

STATEMENT OF FEDERALLY SPONSORED RESEARCH OR DEVELOPMENT

Not applicable.

BACKGROUND

This disclosure is related to assemblies for vehicle door handles and, more specifically, to improved assemblies for the retention of lock cylinders and associated components in handle assemblies.

Most vehicle doors include handle assemblies that facilitate the opening of a closed door. Typically, a handle strap can be pulled in order to release a latch that holds a portion of the door to the frame of the car. In most instances, there is a separate locking mechanism that is installed that permits the door to be selectively locked to inhibit access to the vehicle via the door or to prevent the door from inadvertently opening during operation of the vehicle.

One portion of many door handle assemblies is a lock cylinder that is adapted to receive a physical key. Because lock cylinders are made to only work with a certain set of keys, this component often varies from one door handle assembly to another. This means that often, the lock cylinder needs to be separately installed in the door handle assembly during the assembly of the door. Alternatively, sometimes a cover cap is installed instead of a lock cylinder in assemblies in which a lock cylinder is not required by the design of the door.

Conventionally, many lock cylinders and associated cover cap components are retained in a mounting bracket within the door by use of a retention screw within the assembly. In this arrangement, the lock cylinder is first axially inserted into an opening in the door handle assembly from the exterior side of the vehicle. With the lock cylinder in place, a screw on the shut face of the door (that is, the face of the door that is on the side of the door between the major internal and external sides of the door) is turned in order to drive a clip into place. The threads of the screw engage a portion of the clip (for example, an opening having threads or other features that engage the threads of the retention screw) to cause the linear actuation of the clip, typically in a direction parallel or co-linear with the axis of the screw. With the clip driven into a retention position, the clip prevents the lock cylinder from axial displacement within the assembly. Conventionally, the legs of the clip engage a radially-extending feature on the side of the lock cylinder or associated cap/cover component in order to prevent that lock cylinder from movement within the handle assembly.

SUMMARY OF THE INVENTION

The screw-driven arrangement described above is sufficient to locate the lock cylinder within the handle assembly, although this arrangement presents a number of potential drawbacks. One drawback of the conventional assembly is that it can require the careful pre-positioning of the lock cylinder within the assembly before the screw is used to drive the clip into place. Further, to drive the clip into position, a tool must be used in order to complete the assembly either manually or through the use of a power tool.

Disclosed herein is an improved assembly that does not require the use of tools in order to install the lock cylinder or other insertion member such as a cover cap. Instead, a retention mechanism that is biased into place is used to retain the insertion member in the bracket. Further, this assembly does not require the precise pre-positioning of the slider clip and could be performed one-handed. In contrast, traditional assembly of the screw/clip arrangement described in the background section has required two hands, one hand to position the lock cylinder while the other hand is used to drive the screw.

A door handle assembly for a door of a vehicle is disclosed that includes a bracket mountable to the door, an insertion member received in and retained in the bracket, and a retaining mechanism that retains the insertion member in the bracket. Depending on the particular type of door, the insertion member may be either a lock cylinder (as would be the case in a door handle assembly providing keyed entry) or a cover cap (as would be the case in a door handle assembly lacking keyed entry). The retaining mechanism includes a biasing member and a movable locking member that is biased into a securing position by the biasing member when the insertion member is fully received in the bracket to retain the insertion member in the bracket. The movable locking member is selectively displaceable from the securing position against a force of the biasing member either to permit insertion of the insertion member in the bracket during assembly or to accommodate disassembly by permitting the insertion member to be removed from the bracket.

In some forms of the door handle assembly, the movable locking member may translationally slide in a direction perpendicular to the direction of insertion of the insertion member into the bracket. However, in other forms, the movable locking member may pivot or rotate rather than slide along a generally linear direction. Such pivoting or rotation might potentially occur either in a plane perpendicular to the direction of insertion of the insertion member or may potentially extend out of this plane. It is contemplated that the movable locking member may interact with the insertion member at a plurality of locations or at just a single location to perform the retaining function.

To permit selective retention of the insertion member in the bracket, one of the insertion member and the movable locking member may have a profiled surface while the other may have a projection. The profiled surface and the projection can be shaped and positioned to engage one another during an insertion of the insertion member into the bracket, such that an engagement of the projection with the profiled surface during insertion of the insertion member into the bracket temporarily displaces the locking member from the securing position against the biasing force of the biasing member in order to permit the insertion member to be received in the bracket. However, when the insertion member is fully inserted into the bracket, the profiled surface and the projection can be shaped such that the movable locking member is biased back into the securing position in order to retain the insertion member into the bracket and prevent its withdrawal from the bracket. In one specific form, the insertion member includes the profiled surface in the form of ramps that are at least partially oblique to the direction of insertion and the movable locking member is generally U-shaped with two legs on opposing sides of the insertion member in which the legs each include projections facing the insertion member for engagement with the ramps. In this form, the ramps may be formed as channels on opposing sides of the insertion member.

It is contemplated that the biasing member might take a number of different forms and be positioned in a number of different configurations while providing the biasing force for the retaining mechanism. For example, in some forms the biasing member may be a coiled spring interposed between the bracket and the movable locking member. However, in other forms, the biasing member may be a leaf spring. In some forms, the biasing member may be integrated into the insertion member such that the movable locking member only begins to receive the biasing force as the insertion member is inserted into the bracket. In such forms, the retention mechanism may be initially divided between the components of the bracket and the insertion member and only fully realized during the insertion action; however, in other forms, the biasing member and the movable locking member may both initially be assembled with the bracket.

Based on the structures disclosed herein, it is contemplated that the insertion member may be assembled into the bracket via the retaining mechanism without the use of tools. Further, in any instances in which the door handle assembly requires disassembly for servicing or the like, a simple rod or punch tool may be used to temporarily displace the movable locking member over the biasing force in order to permit the insertion member to be withdrawn from the bracket.

A method of assembling a door handle assembly of a vehicle is also disclosed that involves a door handle assembly of the type described above. According to the method, an insertion member that is one of a lock cylinder and a cover cap is inserted into a bracket mounted to the door in which the bracket supports a retaining mechanism including a biasing member and a movable locking member in which the biasing member biases the movable locking member towards a securing position. During the step of insertion, the movable locking member is initially displaced from the securing position against a force of the biasing member to permit insertion of the insertion member into the bracket. Upon full reception of the insertion member into the bracket, the movable locking member returns to the securing position to retain the insertion member in the bracket.

As noted above, the insertion member may be assembled into the bracket via the retaining mechanism during the step of inserting without the use of tools.

It is further contemplated that, after the step of inserting the insertion member into the bracket, the movable locking member may be displaced from the securing position against a force of the biasing member in order to accommodate disassembly by permitting the insertion member to be withdrawn from the bracket.

These and still other advantages of the invention will be apparent from the detailed description and drawings. What follows is merely a description of some preferred embodiments of the present invention. To assess the full scope of the invention, the claims should be looked to as these preferred embodiments are not intended to be the only embodiments within the scope of the claims.

DETAILED DESCRIPTION OF THE PREFERRED EMBODIMENTS

Figure 1:
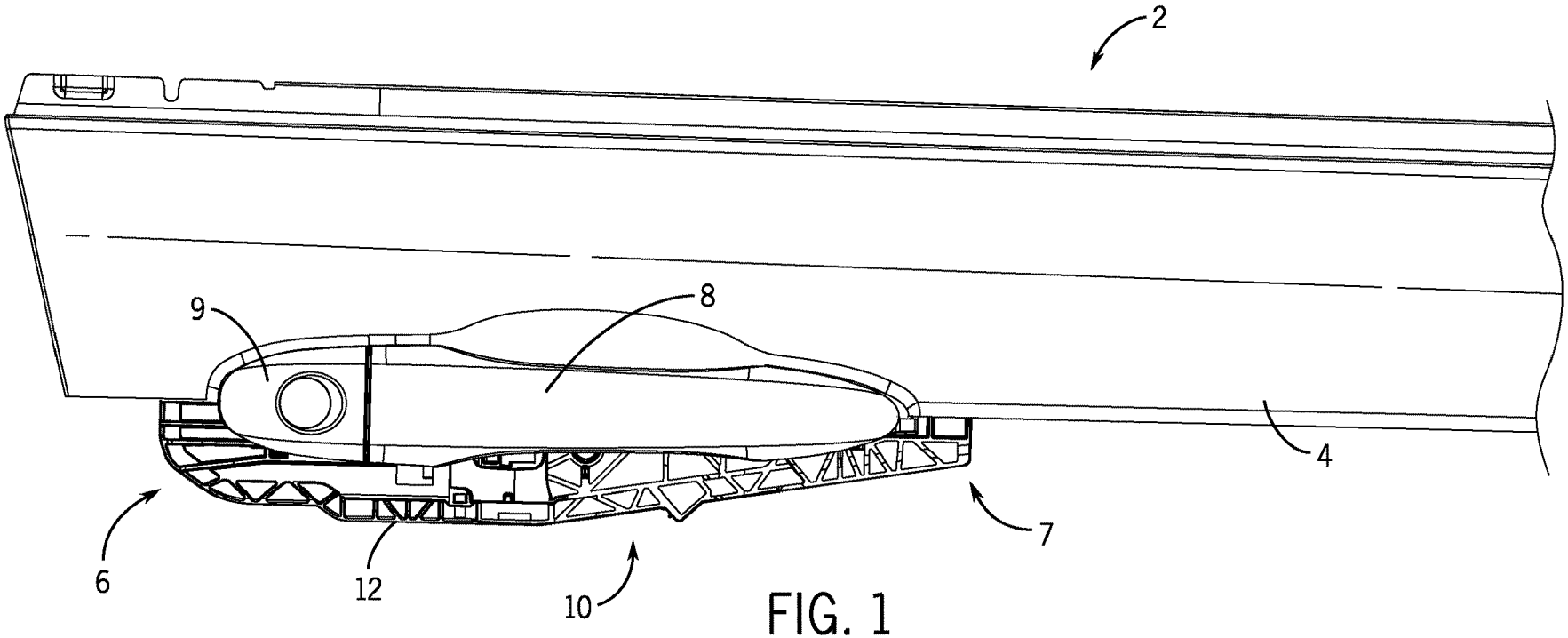
FIG. 1 is a front side view of the door handle assembly on the exterior side of a door of a vehicle in which a lower section of the door is broken away to reveal the bracket.

Referring first to FIG. 1, a portion of a door 2 for a vehicle is illustrated including a door handle assembly 10. In the particular view illustrated, the door 2 includes an upper portion of an exterior panel 4 of the door 2, the lower half of the panel 4 is not shown to reveal the components beneath the panel. The door handle assembly 10 is typically mounted to a structural body of door 2 at the bracket 12 which extends from a rearward end 6 to a forward end 7. On the exterior side of the door 2, the door handle assembly 10 includes a handle strap 8, which can be pulled to unlatch the door 2 from the frame of the vehicle to permit the door 2 to pivot and open. Proximate the rearward end 6, the door handle assembly 10 also includes a cap section 9 that may support a lock cylinder or a cover.

Figure 2:
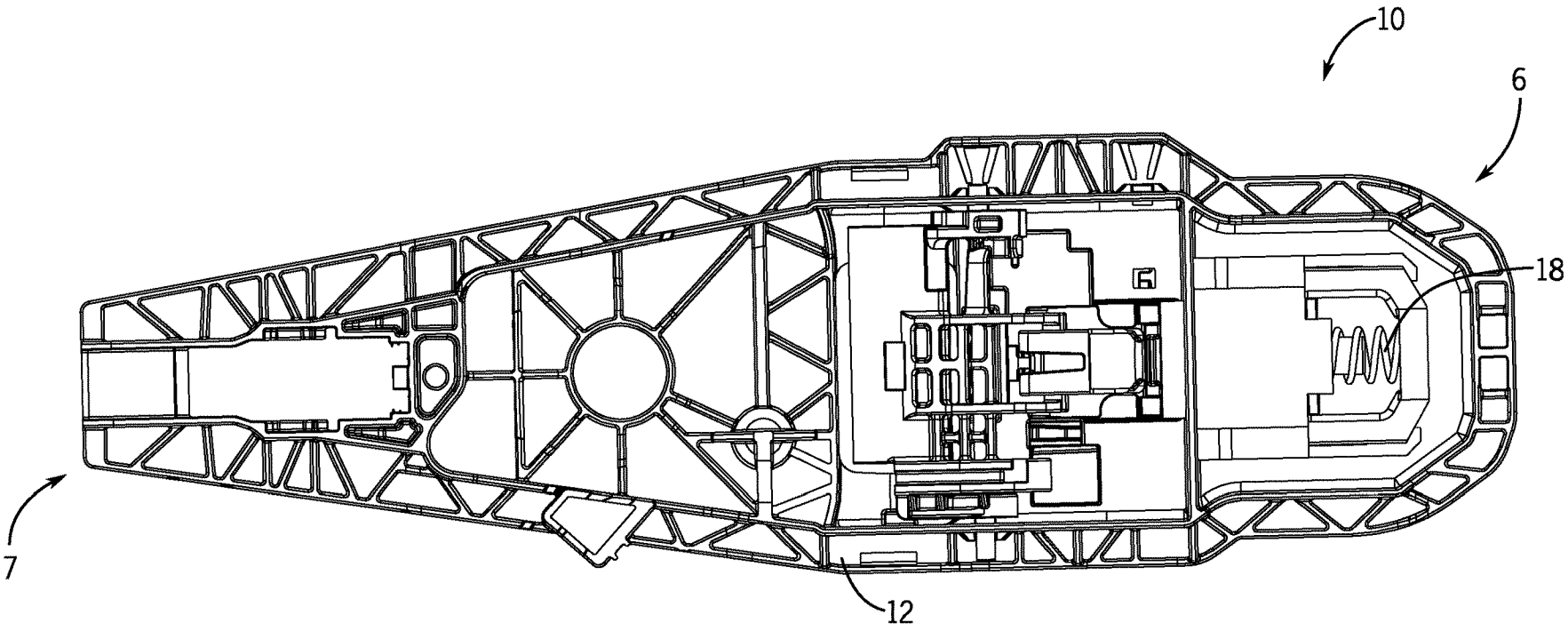
FIG. 2 is a rear side view of the bracket apart from the door.
Figure 3:
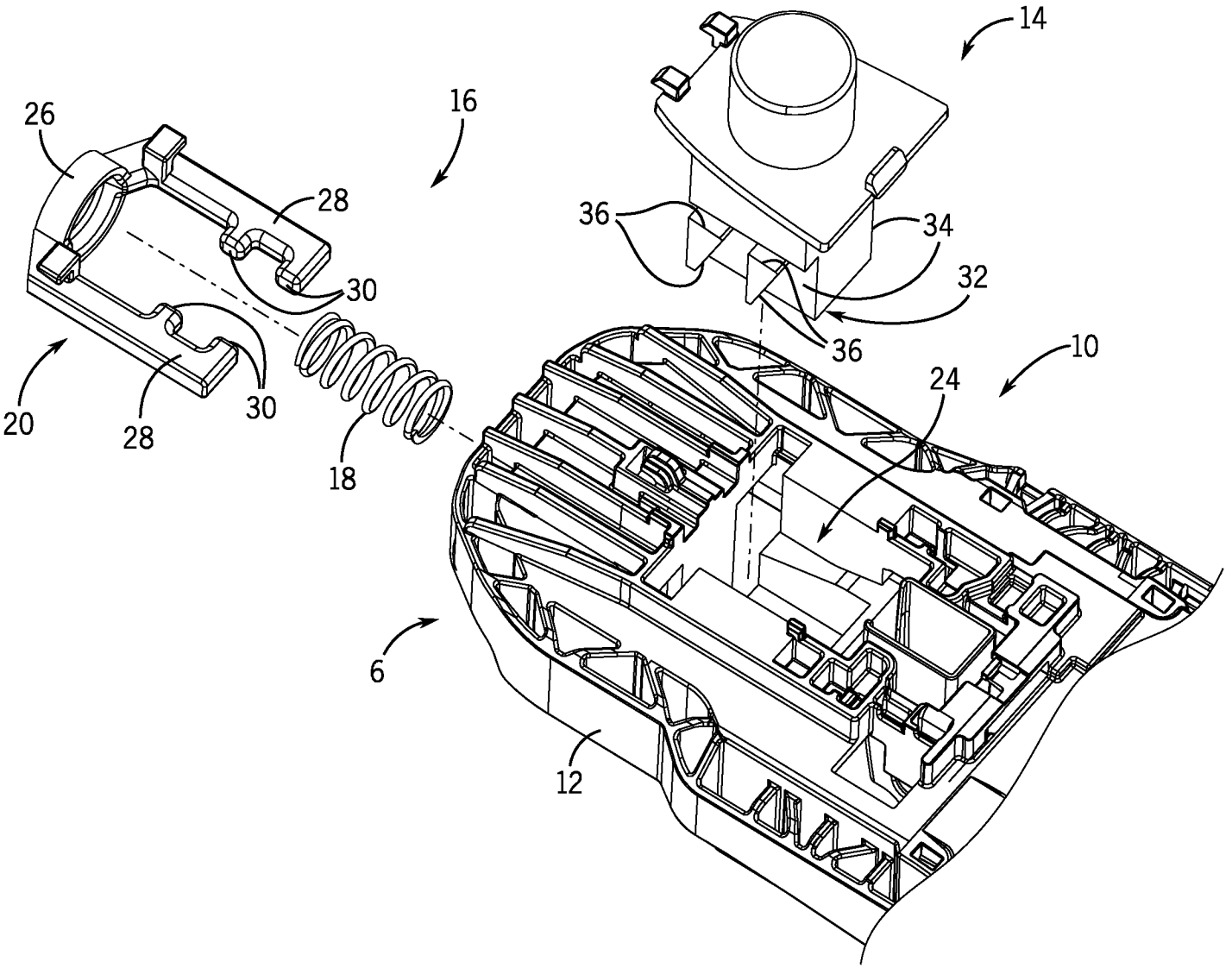
FIG. 3 is a perspective view of the rear end of the bracket of the door handle assembly in which the insertion member and the retention member are exploded away from the bracket.

Turning now to FIGS. 2 and 3 to provide additional context for the detailed description of the moving parts on the rearward end 6 of the bracket 12 that follows, additional views of the bracket 12 and parts of the door handle assembly 10 are illustrated. In FIG. 2, a back side of the bracket 12 (that is, the side of the bracket that faces the interior side of the door 2) is shown in which the bracket 12 is separated from the rest of the door 2 to better reveal the overall shape of the bracket 12. In FIG. 3, a detailed perspective view of the rearward end 6 of the bracket 12 is illustrated in which an insertion member 14 and a retaining mechanism 16 including a biasing member 18 and a movable locking member 20 are exploded from the bracket 12. After performing the assembly that follows, the retaining mechanism 16 is used to retain the insertion member 14 in the bracket 12.

Figure 4A:
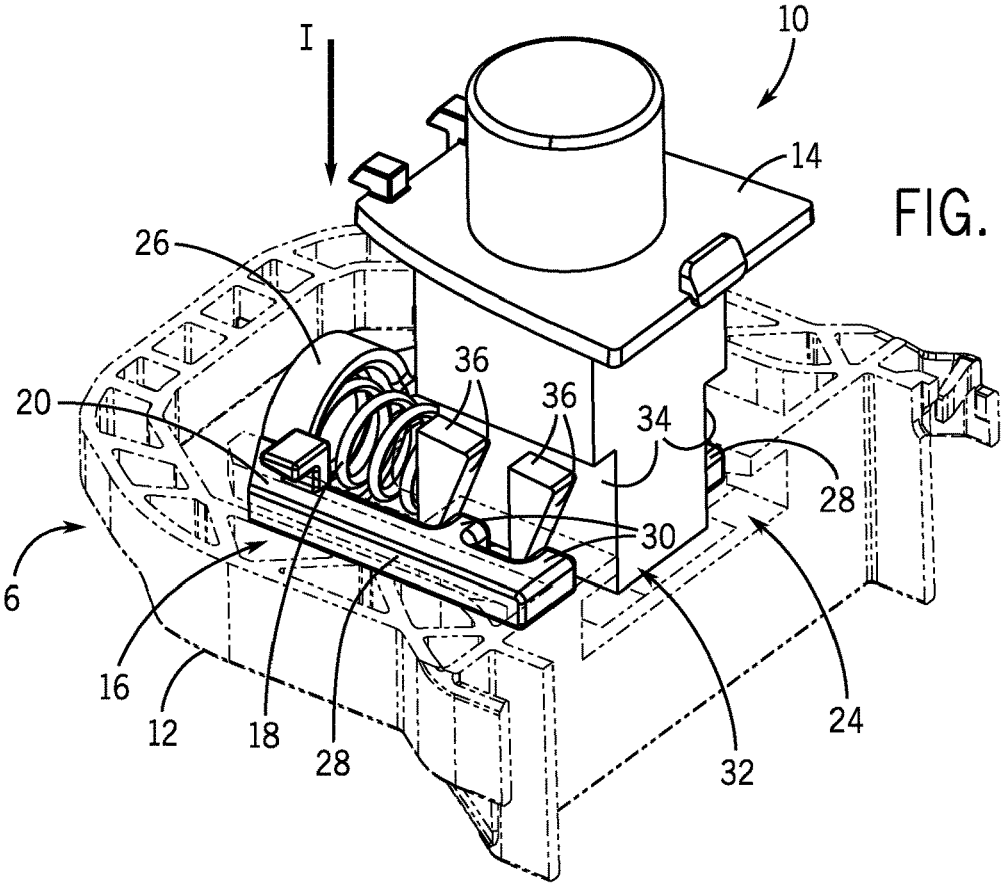
FIGS. 4A through 4C depict the stepwise insertion of the insertion member into the bracket of a door handle assembly.
Figure 4B:
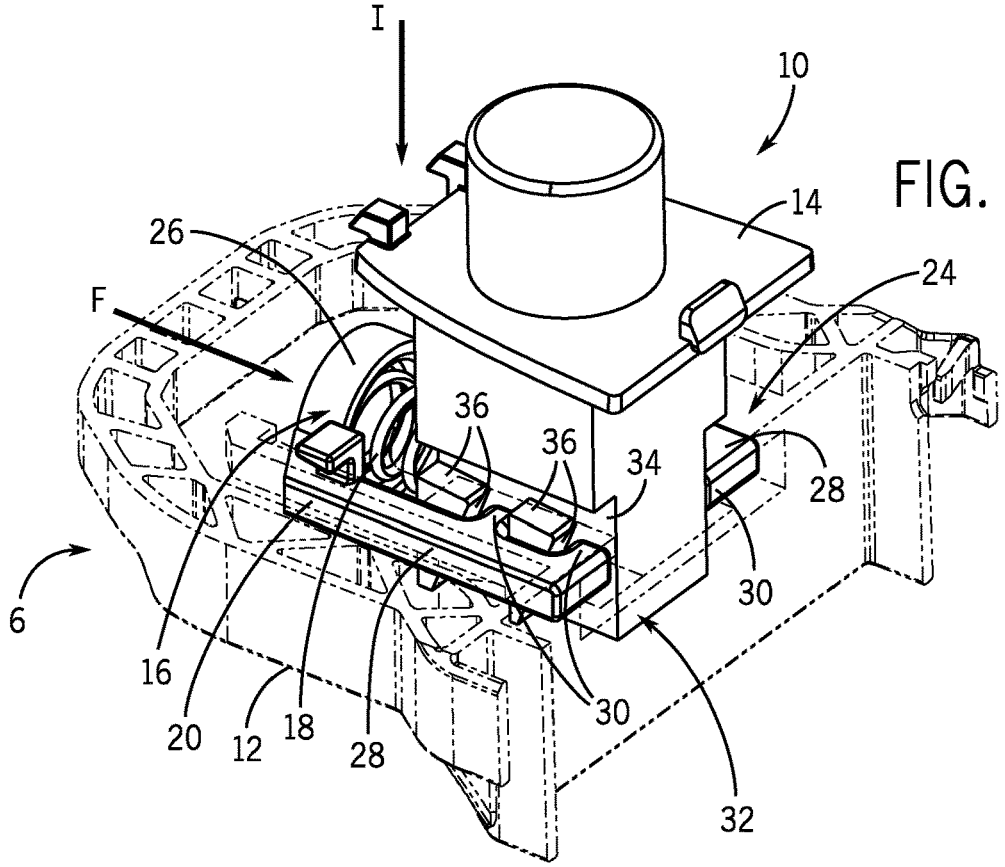
Figure 4C:
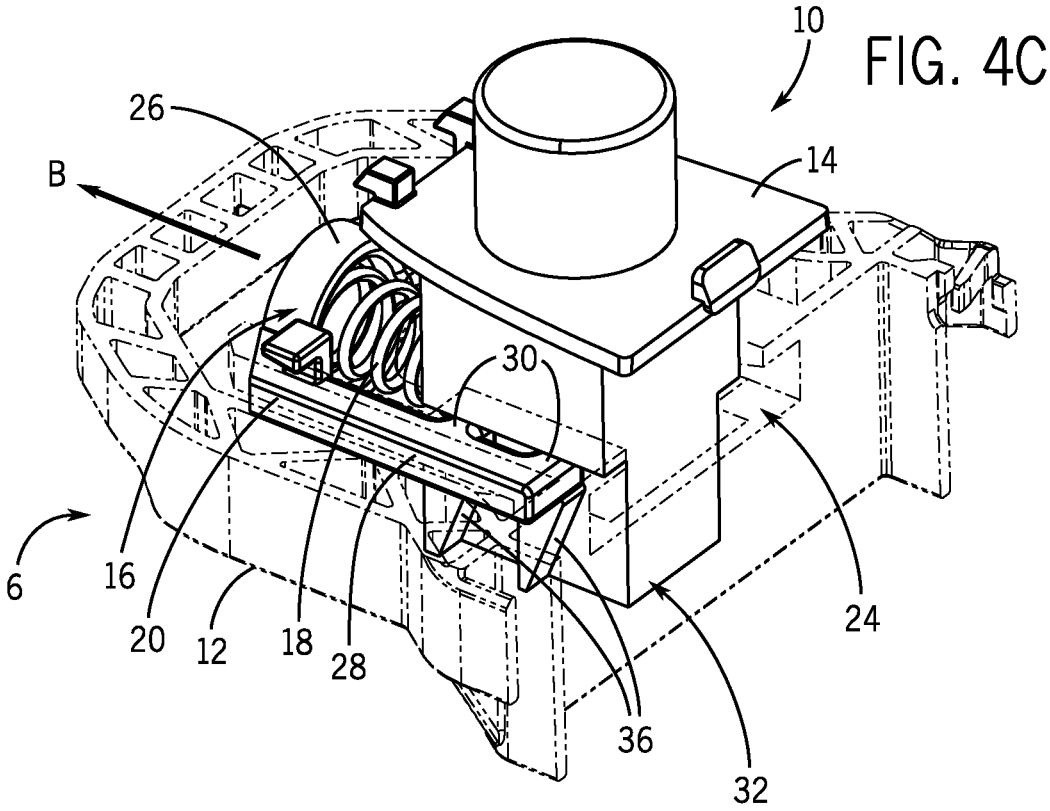

Referring now to FIGS. 4A through 4C, the rearward end 6 of the bracket 12 of the door handle assembly 10 is illustrated over various steps of assembly in which the insertion member 14 is inserted into the bracket and retained in the bracket 12 by the retaining mechanism 16. It will be appreciated that the illustrated door handle assembly 10 is but one embodiment in accordance with the disclosed invention and that variations may be made to this structure without departing from the scope of the invention, which is defined by the attached claims.

The particular portion of the door handle assembly 10 illustrated includes various components including the bracket 12, the insertion member 14, and the retaining mechanism 16 including the biasing member 18 and the movable locking member 20. As used in this application, the term "insertion member" is used to encompass either a lock cylinder or cover cap that is received and retained in the bracket 12 by use of the retaining member 16. Whether a lock cylinder or cover cap is used in a particular assembly depends on the specific details of the specific door handle assembly and vehicle design. For example, in most driver side doors having keyed entry, a lock cylinder would be inserted into the bracket 12. However, for certain front and rear passenger side doors, in which direct keyed entry is not available or desired, then a cover cap may be inserted instead of a lock cylinder in order to complete the handle assembly, to retain the handle strap 8 in position, and to provide a cap that helps to provide a desired external appearance for the door handle assembly 10.

Looking more specifically at the bracket 12, the bracket 12 is designed or adapted to be mounted to a door of a vehicle and is used to support the handle. For the sake of clarity, it is again noted that only the rearward end 6 the bracket 12 is shown in FIGS. 4A-4C.

The functions of brackets, such as bracket 12, with respect to the handle support are relatively well known to those having ordinary skill in the art and will not be described in great detail in this application. In short, a bracket 12 of this type is mounted to an inside of the door 2 and a handle strap 8 is inserted into the forward end 7 of the bracket in order to establish a pivot point for the handle strap 8. In order to secure the handle strap 8 into the bracket 12, on the side of the handle strap 8 in which a leg typically extends through the bracket 12 (that is, the side of the handle strap 8 closest to the rearward end 6 of the bracket 12), an insertion member 14, such as a lock cylinder or cover cap, is inserted into a space or opening in the bracket in order to prevent the handle strap 8 from being able to slide back out. Again, this greater assembly is depicted at least to some extent in FIG. 1.

Notably, FIGS. 4A through 4C depict an improved structure to accommodate the assembly of the insertion member 14 into an opening 24 of the bracket 12 without the use of tools. Whereas the prior art door handle assemblies discussed in the background section above would have involved the manual driving of a screw to position a clip or collar once an insertion member was already pre-positioned within the bracket, by virtue of the use of the retaining mechanism 16, the installation of the insertion member 14 in the door handle assembly 10 can be completed without tools by the simple act of insertion of the insertion member 14 into the bracket 12.

As illustrated and with additional reference being made back to FIG. 3, the bracket 12 supports the retaining mechanism 16 including the biasing member 18 and the movable locking member 20. The movable locking member 20 is generally U-shaped having a base 26 with two spaced legs 28 projecting therefrom. Each of the legs 28 have a pair of inwardly facing projections 30 that are adapted for engagement with the insertion member 14 as will be described in greater detail below. The base 26 of the movable locking member 20 is adapted to receive one end of the biasing member 18, which is a coil spring in the form illustrated. Such adaption may be provided, for example, by providing a cylindrical recess in the base 26 of the movable locking member. The end of the biasing member 18 not received in the base 26 contacts a portion of the bracket 12 to apply a biasing force therebetween that causes the movable locking member 20 to tend toward a securing position as illustrated in FIG. 4C. This securing position of the movable locking member 20 in FIG. 4C is also close to or the same position of the movable locking member 20 in the bracket 12 depicted in FIG. 4A, albeit without the insertion member 14 secured or retained in place.

In the form illustrated, the movable locking member 20 is generally restricted to linear translational movement in the directions of F (for "forward") as illustrated in FIG. 4B and of B (for "backward") as illustrated in FIG. 4C. This restriction in motion is based on the way in which the movable locking member 20 is received in the bracket 12 and can be the result of the movable locking member 20 being seated in a groove or channel in the bracket 12.

The movable locking member 20 is biased by the biasing member 18 in the direction indicated by arrow B in FIG. 4C into the securing position or locking position. If a sufficient force is applied to overcome the biasing force supplied by the biasing member 18, then the movable locking member 20 can move in a direction F as depicted in FIG. 4B.

Looking now more closely at the insertion member 14, it can be seen that the insertion member 14 has a base end 32 having two opposing lateral sides each having a pair of recesses 34 formed therein that receive the projections 30 on the legs 28 of the movable locking member 20. In the particular form illustrated, the recesses 34 have profiled surfaces 36 which provide ramps or ramped sections on a bottom end thereof and cutback sections on a top end thereof. The shape of the profiled surfaces 36 along with corresponding projections 30 result in the displacement of the movable locking member 20 against the biasing force of the biasing member 18 during the axial insertion of the insertion member 14 in the region of the ramps as the profiled surfaces 36 and projections 30 interfere with, bear on, or engage one another. In the region of the cutbacks, there is sufficient room for the movable lock member 20 to return to the securing position as the projections 30 no longer act against the biasing force as they did in the region of the ramps. It is noted that, in the illustrated embodiment, the profiled surfaces 36 and recesses 34 have reflectional symmetry across a central plane of the insertion member 14. Thus, even though one of the two sides of the insertion member 14 is shown, it will be readily appreciated that the other side is of similar shape and so illustration of this other side is unnecessary.

As depicted in the progressive steps depicted in FIGS. 4A through 4C, the assembly of the door handle assembly 10 by insertion of the insertion member 14 into the bracket 12 is depicted.

In FIG. 4A, the insertion member 14 is inserted base end 32 first into the opening 24 of the bracket 12 along a direction of insertion I which is parallel with a central axis of the insertion member 14. For context, the direction of insertion I is generally perpendicular to the exterior side of the door 2 in most handle assemblies as well as to the direction of translation movement of the movable locking member 20.

As the base end 32 of the insertion member 14 is inserted into the opening 24 of the bracket 12, the projections 30 on the legs 28 of the movable locking member 20 engage and bear on the profiled surfaces 36 of the insertion member 14. As the insertion member 14 continues along the direction of insertion I, this engagement of the projections 30 and the profiled surfaces 36 cause the movable locking member 20 to be displaced relative to the bracket 12 in the direction indicated by the arrow F (which corresponds to a forward translation of the movable locking member 20 against the biasing force). This displacement occurs as the downward force applied during the insertion of the insertion member 14 causes the ramps of the profiled surfaces 36 to interfere with the projections 30 in an amount sufficient to overcome the biasing force applied by the biasing member 18.

After the insertion member 14 has been inserted to an insertion depth past which the projections 30 engage the ramped portions of the profiled surfaces 36 as illustrated in FIG. 4C, then the projections 30 are able to recoil back into the cutbacks of the recesses 34 permitting the movable locking member 20 to travel back to the secure or locking position due to the now unobstructed biasing force applied by the biasing member 18 in a biasing direction indicated by the arrow B. This movement of the movable locking member 20 into the securing position within the bracket 12 prevents the insertion member 14 from being withdrawn back out of bracket 12 along a direction opposite to the direction of insertion I (labeled in FIGS. 4A and 4B) as the projections 30 of the movable locking member 20 would engage the lower surface of the cutbacks and prevent the insertion member 14 from being removed from the opening 24. The only way in which the insertion member 14 might be removed from the bracket 12 at this point would be if the movable locking member 20 was displaced from the secure position against the biasing force of the biasing member 18 in the direction F, which would likely be performed only by an individual performing maintenance using a tool such as a punch or rod to contact the base end 26 of the movable locking member 20 to move the movable locking member 20 away from the securing position. With this displacement, the projections 30 would be cleared of the cutbacks and the insertion member 14 could be extracted from the bracket 12 in a direction opposite to the direction of insertion I.

While the form of the invention depicted in FIGS. 4A through 4C involves the linear translation of the movable locking member (which is suitable to achieve the selective securing function described herein in conjunction with the insertion member), it is contemplated that other types of biased locking members might be used in order to achieve the same functionality without departing from the scope of the invention. For example, the movable locking member may be constructed to rotate, rather than linearly translate when the movable locking member interacts with the insertion member during assembly. Such rotation might occur in a plane parallel with the plane of translation in the illustrated embodiment or may occur outside of this plane. In such a situation, the insertion member would have a corresponding geometry that engages with the rotating elements to permit insertion of the insertion member to overcome the biasing force, but upon full insertion of the insertion member, cause the rotating elements to (at least temporarily) lock, retain, and secure the insertion member relative to the bracket.

Other variations to the retaining mechanism 16 are contemplated. For example, the movable locking member may be a unitary item or comprise multiple separately movable members. Still yet, it is contemplated that the movable locking member and the biasing member may either be separate from one another, as illustrated, or be combined with one another in a manner in which the biasing member is integrally formed with the movable locking member. Additionally, the biasing member may take forms other than a coiled spring such as, for example, a leaf spring. Other non-spring biasing mechanisms may also be used such as for example mechanisms involving magnets, compressible hydraulic elements, temporarily deformable elements, and so forth.

It is also contemplated that the arrangements of the engaging elements on the movable locking member and the insertion member may be reversed or altered in shape. For example, one might reverse the placement of projections and recesses on the movable locking member and the insertion member. Further, rather than one member having projections and the other recesses with profiled surfaces, both members may have projections or profiled surfaces that contact one another. It is observed that, even in the illustrated embodiment, the recesses formed on the sides of the insertion member actually create projections as defined from the bottom of the recesses. In any event, one having ordinary skill in the art will appreciate that the specific geometries and arrangement of the engaging features may be altered to achieve a similar displace-and-lock effect described in the assembly described above.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A door handle assembly comprising:

a bracket;

a locking member supported by the bracket for translation between a first position and a second position, the locking member including a first leg, a second leg opposite the first leg, and a base extending between the first leg and the second leg, the first leg extending from the base and including a first end and a first projection, the first end disposed opposite the base, the first projection disposed between the base and the first end and including a first side facing the base, a second side facing the first end, and a bottom side, the second leg extending from the base and including a second end and a second projection, the second end disposed opposite the base, the second projection disposed between the base and the second end and including a first side facing the base, a second side facing the second end, and a bottom side;

a biasing member having a first end engaging the locking member and a second end engaging the bracket to bias the locking member from the first position to the second position; and an insertion member including a forward end, a rearward end opposite the forward end, a first lateral side between the forward end and the rearward end, and a second lateral side opposite the first lateral side and between the forward end and the rearward end, the first lateral side defining a first recess therein, the second lateral side defining a second recess therein, the insertion member further including a first ramp member disposed in the first recess and a second ramp member disposed in the second recess, the first ramp member and the second ramp member each including a top profiled surface and a ramped profiled surface, wherein, during insertion of the insertion member into the bracket, (i) the first side of the first projection is configured to translate along the ramped profiled surface of the first ramp member, (ii) the first side of the second projection is configured to translate along the ramped profiled surface of the second ramp member, (iii) the bottom side of the first projection is configured to translate along the top profiled surface of the first ramp member to secure the insertion member within the bracket, and (iv) the bottom side of the second projection is configured to translate along the top profiled surface of the second ramp member to secure the insertion member within the bracket.

2. The door handle assembly of claim 1, wherein the first side and the first end define a void therebetween.

3. The door handle assembly of claim 2, wherein the void extends through the locking member.

4. The door handle assembly of claim 1, wherein the first projection and the base define a first L-shape, and the first projection and the first end define a second L-shape.

5. The door handle assembly of claim 4, wherein the first L-shape and the second L-shape are each disposed between the base and the first end.

6. The door handle assembly of claim 1, wherein the base includes a cylindrical recess, the first end of the biasing member disposed within the cylindrical recess.

7. The door handle assembly of claim 1, wherein the insertion member includes an upper surface and wherein the first lateral side extends from the upper surface, the upper surface and the first lateral side each extending from the forward end and at least partially defining the first recess.

8. The door handle assembly of claim 7, wherein the ramped profiled surface extends transverse to the top profiled surface, the top profiled surface facing the upper surface, and the ramped profiled surface facing the forward end.

9. The door handle assembly of claim 8, wherein the ramped profiled surface extends from the top profiled surface.

10. A door handle assembly comprising:

a bracket;

an insertion member including a forward end, a rearward end opposite the forward end, a first lateral side between the forward end and the rearward end, and a second lateral side opposite the first lateral side between the forward end and the rearward end, the first lateral side defining a first recess therein, the second lateral side defining a second recess therein, the insertion member further including a first ramp disposed within the first recess, and a second ramp disposed within the second recess, the bracket configured to translatably receive the insertion member in an insertion direction;

a locking member supported by the bracket for translation between a first position and a second position and including a first leg, a second leg opposite the first leg, and a base extending between the first leg and the second leg, the first leg extending from the base and including a first end and a first projection, the first end disposed opposite the base, the first leg including a projection extending toward the second leg and including a first side, a second side opposite the first side, and a bottom side, the first side spaced apart from the base and defining a first void therebetween, the second side spaced apart from the first end defining a second void therebetween, the second leg extending from the base and including a second end and a second projection, the second end disposed opposite the base, the second projection extending toward the first leg and including a first side, a second side opposite the first side, and a bottom side, the first side of the second leg spaced apart from the base and defining a first void therebetween, the second side of the second leg spaced apart from the second end and defining a second void therebetween; and a biasing member having a first end engaging the locking member and a second end engaging the bracket to bias the locking member from the first position to the second position, wherein, during insertion of the insertion member into the bracket, (i) the first side of the first projection is configured to translate along the first ramp within the first recess in a first direction, (ii) the first side of the second projection is configured to translate along the second ramp within the second recess in the first direction, (iii) the bottom side of the first projection is configured to translate along the first ramp in a second direction transverse to the first direction to secure the insertion member within the bracket, and (iv) the bottom side of the second projection is configured to translate along the second ramp in the second direction to secure the insertion member within the bracket.

11. The door handle assembly of claim 10, wherein the first projection and the base define a first L-shape, and the first projection and the first end define a second L-shape.

12. The door handle assembly of claim 11, wherein the first L-shape and the second L-shape are each disposed between the base and the first end.

13. The door handle assembly of claim 10, wherein the base includes a cylindrical recess, the first end of the biasing member disposed within the cylindrical recess.

14. The door handle assembly of claim 10, wherein the insertion member includes an upper surface, the first lateral side extending from the upper surface, the upper surface and the first lateral side each extending from the forward end and at least partially defining the first recess.

15. The door handle assembly of claim 14, wherein the first ramp includes a top surface and a profiled surface extending transverse to the top surface, the top surface facing the upper surface, and the profiled surface facing the forward end.

16. The door handle assembly of claim 15, wherein the profiled surface extends from the top surface.

17. A method of assembling a door handle assembly, the door handle assembly including a bracket, a locking member supported by the bracket and including a first leg, a second leg opposite the first leg, and a base extending between the first leg and the second leg, the first leg including a first projection and a first end, the first projection including a first side, a second side, and a bottom side, the first side spaced apart from the first end and defining a first void with the first end, the second side spaced apart from the base and defining a second void with the base, the second leg including a second projection and a second end, the second projection including a first side, a second side, and a bottom side, the first side of the second projection spaced apart from the second end and defining a first void with the second end, the second side of the second projection spaced apart from the base and defining a second void with the base, the method comprising:

inserting an insertion member into the bracket, the insertion member including a forward end, a rearward end opposite the forward end, a first lateral side, and a second lateral side opposite the first lateral side, the first lateral side and the second lateral side extending between the forward end and the rearward end, the first lateral side and the second lateral side each defining a recess, the insertion member further including a first ramp disposed within the recess of the first lateral side, and a second ramp disposed within the recess of the second lateral side, wherein the step of inserting, further includes:

translating the first ramp in a first direction along the second side of the first projection and through the first void;

translating the second ramp in the first direction along the second side of the second projection and through the second void;

translating the bottom side of the first projection in a second direction along the first ramp to retain the insertion member in the bracket; and translating the bottom side of the second projection in the second direction along second ramp to retain the insertion member in the bracket.

18. The method of claim 17, wherein the first direction is transverse to the second direction.

19. The method of claim 17, further comprising biasing the locking member in the second direction.

* * * * *